US005784092A

United States Patent [19]

Fukuoka

[11] Patent Number: 5,784,092

[45] Date of Patent: Jul. 21, 1998

[54] THERMAL PRINTER IN WHICH HEAD ENERGIZATION PERIOD IS CONTROLLED BASED ON NUMBER OF HEADS TO BE ENERGIZED

[75] Inventor: Hiroaki Fukuoka, Ise, Japan

[73] Assignee: Shinko Electric Co., Ltd., Tokyo, Japan

[21] Appl. No.: 362,863

[22] Filed: Dec. 23, 1994

[30] Foreign Application Priority Data

Dec. 24, 1993 [JP] Japan ..... 5-326755

[51] Int. Cl.[6] ..... B41J 2/36

[52] U.S. Cl. ..... 347/190

[58] Field of Search ..... 347/188, 190, 347/192, 183, 211; 400/120.09, 120.1, 120.12

[56] References Cited

U.S. PATENT DOCUMENTS

| | | | |
|---|---|---|---|
| 4,219,824 | 8/1980 | Asai | 347/190 |
| 4,389,935 | 6/1983 | Arai | 347/190 |
| 4,454,516 | 6/1984 | Moriguchi et al. | 347/190 |
| 4,510,505 | 4/1985 | Fukui | 347/190 |
| 4,893,190 | 1/1990 | Takanashi et al. | 347/190 |
| 4,967,205 | 10/1990 | Sakaguchi et al. | 367/190 |
| 5,053,790 | 10/1991 | Stephenson et al. | 347/190 |
| 5,469,203 | 11/1995 | Hauschild | 347/190 |
| 5,629,730 | 5/1997 | Park | 347/188 |

FOREIGN PATENT DOCUMENTS

| | | | |
|---|---|---|---|
| 4-255365 | 9/1992 | Japan | 347/190 |
| 5-246070 | 9/1993 | Japan | 347/190 |

*Primary Examiner*—Huan H. Tran
*Attorney, Agent, or Firm*—Bacon & Thomas, PLLC

[57] ABSTRACT

By counting the number of thermal printer head elements to be energized for each gradation, and adjusting the energizing period on the basis of the counted number, a common energizing period is obtained in order to prevent density unevenness which would otherwise occur because of differences in the number of head elements to be energized for each gradation.

1 Claim, 2 Drawing Sheets

THERMAL PRINTER IN WHICH HEAD ENERGIZATION PERIOD IS CONTROLLED BASED ON NUMBER OF HEADS TO BE ENERGIZED

BACKGROUND OF THE INVENTION

1. Field of the invention

The invention relates to a thermal printer in which gradation density of a printed image are realized by controlling a period of energizing each of head elements of a thermal head.

2. Related art

In a line-type sublimation thermal printer, when gradation densities are realized by controlling a period of energizing each of head elements (heating elements) of a thermal head, various gradation data are generated for each line (in the case where each image data consists of 8 bits, for example, there are 0th to 255th gradation).

When an ith head element in the main line scanning direction is to be energized so as to realize a gradation m, a gradation pulse such as shown in FIG. 4 is applied to the ith head element so that the target density $D_m$ is realized.

When a large number of head elements of one line are simultaneously energized, the energy supplied to one of the head elements is reduced in level so that each head element generates a small amount of heat. Even when such head elements are energized in a fixed period, resulting densities are low and density unevenness is produced.

Specifically, when a power source voltage of such a thermal printer is $V_O$, the value of the common resistance elongating from the power source to a group of head elements is r, the number of head elements to be energized is n, the voltage applied to the head elements is V, the current supplied to the head elements is I, and the resistance of the head elements is R, the following relationship holds:

$$\begin{aligned} V &= V_0 - rI = V_0 - rV/R \\ &= V_0R/(nr+R) \end{aligned}$$

When an energizing period is T, therefore, the energy supplied to one head element is expressed by:

$$[V_0R/(nr+R)]^2T/R \quad (1)$$

The amount of heat generated by a head element is proportional to the energy supplied to the head element. In the case where the number n of head elements to be energized is large, therefore, each head element generates a reduced amount of heat even when the head elements are energized in a fixed period.

SUMMARY OF THE INVENTION

The invention has been conducted in order to solve this problem. It is an object of the invention to provide a thermal printer in which density unevenness due to a difference in the number of head elements to be energized between gradation is prevented from occurring.

In order to attain the object, according to the invention, a thermal printer in which gradation of a printed image are realized by controlling a period of energizing each of head elements of a thermal head is configured so that the printer comprises means for counting the number of elements to be energized for each gradation, among the head elements, and means for adjusting the energizing period on the basis of the counted number.

In the invention, the number of elements to be energized among all the head elements is counted for each gradation, and the energizing period is adjusted in a manner common to the elements to be energized, on the basis of the counted number.

DETAILED DESCRIPTION OF PREFERRED EMBODIMENTS

Hereinafter, an embodiment of the invention will be described with reference to the drawings.

Figure 1:
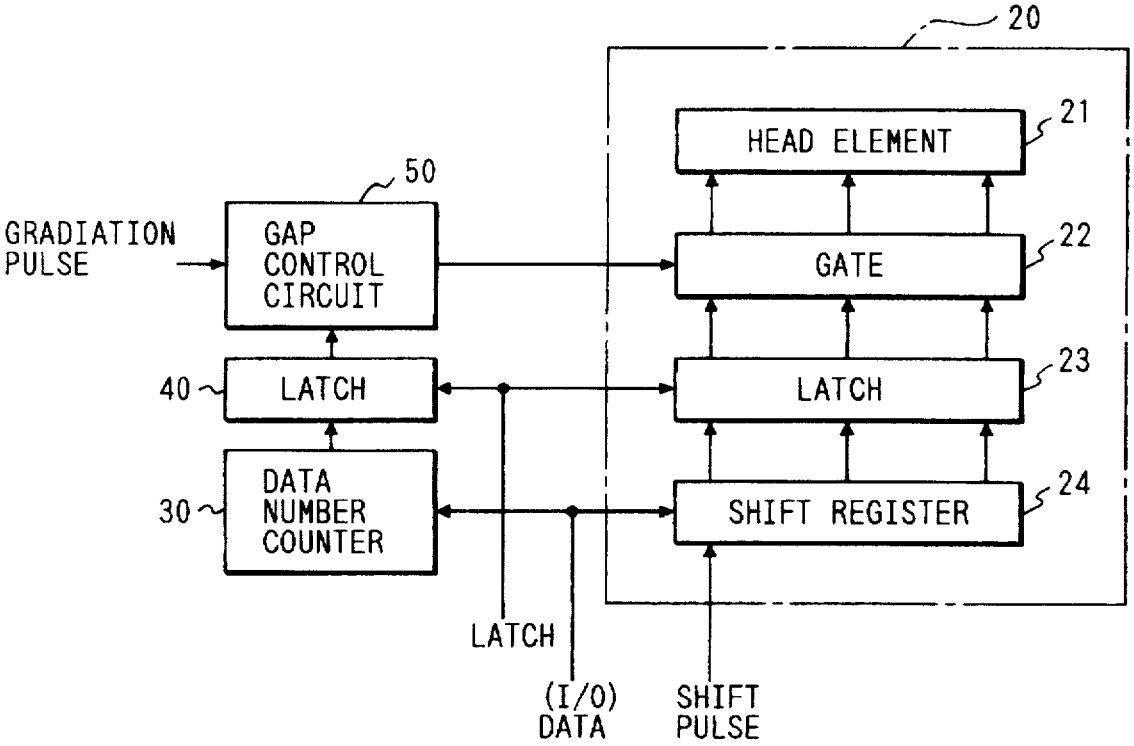
FIG. 1 is a block diagram showing a first embodiment of the invention.

In FIG. 1, 1/0 designates data of [1] and [0] indicative of energization and unenergization of each element for each gradation. The data are supplied from an external circuit which is not shown, and the data for each gradation are stored in a shift register 24 of a thermal head 20. The reference numeral 30 designates a data number counter which counts data of [1] among the data for one gradation, and 40 designates a latch which latches the count value X of the data number counter 30 in response to a latch signal. When receiving the latch signal, a latch 23 of a thermal head latches the data for one gradation which are in the shift register 24 and to be printed out in the next printing process. The count value X captured in the latch 40 indicates the number of elements in which the value to be printed out in the next printing process is [1]. The reference numeral 50 designates a gap control circuit which receives a gradation pulse $P_K$ (K indicates a gradation level) and adjusts the width of the gradation pulse $P_K$ in accordance with the count value X. The adjusted gradation pulse $P_{K+Ax}$ is sent to a gate 22 of a thermal head. In the gate 22 of the thermal head, gate elements which receive data [1] from the latch 23 conduct the, gating operation so that the gradation pulse $P_{K+Ax}$ is applied as a pulse for a Kth gradation to corresponding elements of a head element 21 of a thermal head. The above process is repeated for each of the 0th to maximum gradation, thereby completing the printing of one line.

Figure 2:
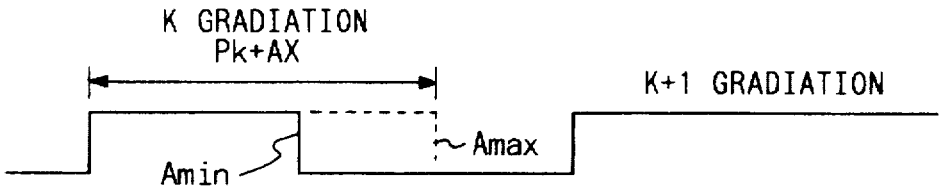
FIG. 2 is a diagram showing a gradation pulse used in the embodiment.

FIG. 2 shows gradation pulses. In the figure, $P_K$ indicates the gradation pulse for the Kth gradiation, and $P_{K+1}$ indicates the gradation pulse for the (K+1)th gradation. The period $AT_X$ is the adjust period which is calculated by the gap control circuit 50 on the basis of the count value X. The period $A_X$ can be adjusted so as to be between the minimum value $A_{MIN}$ and the maximum value $A_{MAX}$.

When the data input to the shift register 24 of a thermal head is conducted in a parallel manner, the calculation is conducted at the input point and count values are added to each other. The sum is supplied to the gap control circuit 50.

Figure 3:
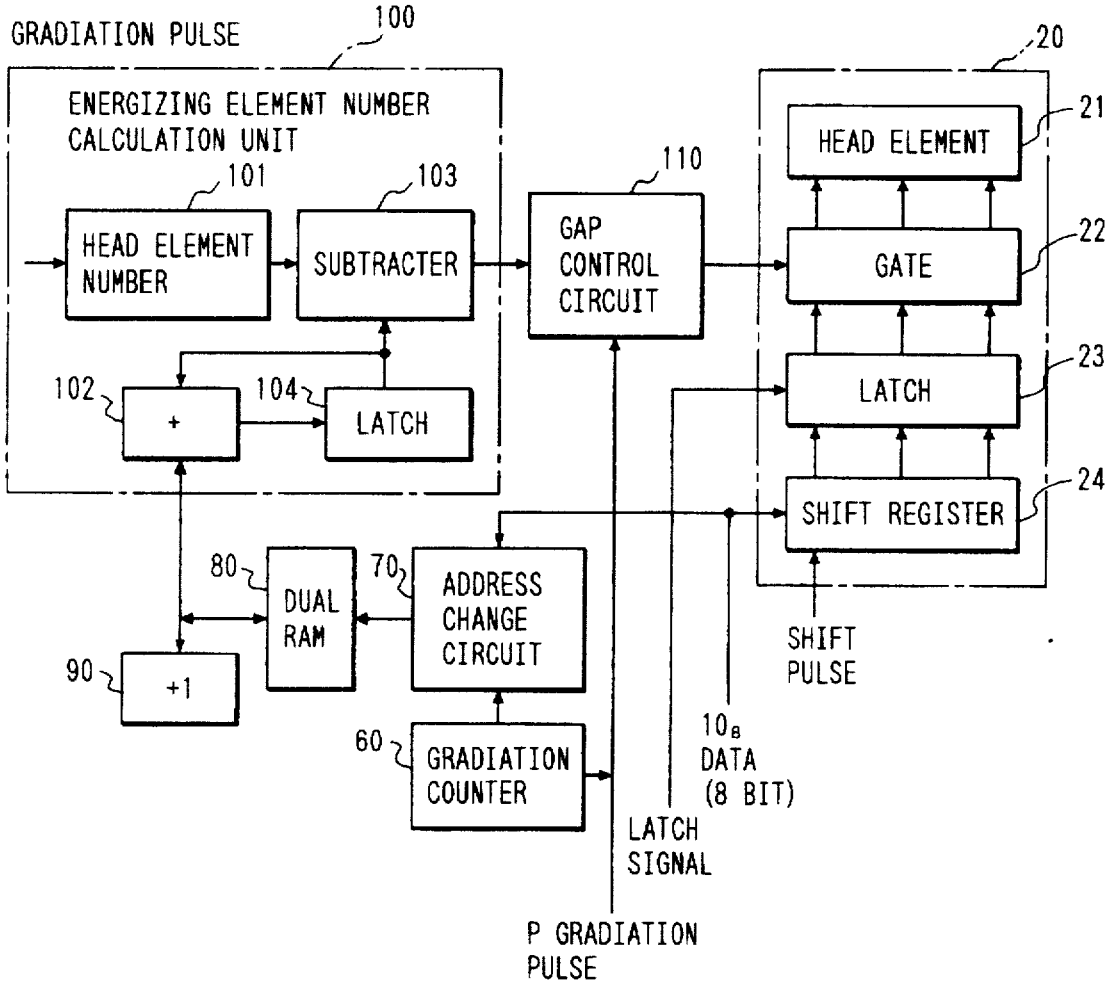
FIG. 3 is a block diagram showing a second embodiment of the invention.
Figure 4:
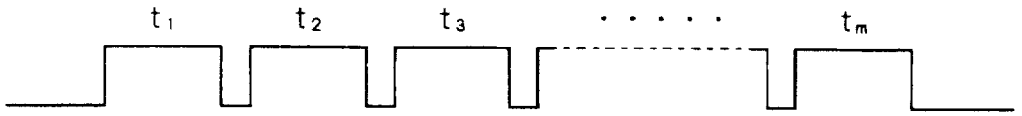
FIG. 4 is a diagram showing a gradation pulse used in a conventional art.

FIG. 3 shows another embodiment of the invention.

In the embodiment, unlike the foregoing embodiment, the gradation control is conducted inside the head. In this case, density data (for example, 8 bits) of each element are sequentially written into the shift register, and the bit arrangements (for example, 100 . . . 01) of all the elements at the gradation output are automatically processed inside the head.

The density data (in this case, 8 bits) of each element are transferred to the shift register 24 of the thermal head 20.

When the process of transferring the density data to the shift register 24 of the thermal head 20 starts, the content of one of addresses 0 to 255 of a memory (dual RAM) 80 is read out with using the value of the density data as an address. The value is then incremented by one in an adder 90, and the reading operation is again conducted. The addresses of the memory 80 are previously cleared to "0" before the transfer process starts.

When all density data of one line have been transferred to the thermal head in this way, a process of energizing all the elements for each of the gradation 0 to 255 starts.

The reference numeral 60 designates a gradation counter which, at each count up, issues an address change command to an address change circuit 70. The gradation counter 60 receives a gradation pulse P from a pulse generator which is not shown.

The reference numeral 100 designates an energizing element number calculation unit that comprises a head element number setting device 101 through which the number N of head elements can be set, an adder 102, a subtracter 103, and a latch 104.

The energization is conducted for a predetermined period in the sequence starting from the 0th gradation.

When the number of the gradation is J and the counted number of data is $D_J$, in the calculation of the number of elements to be energized for the Kth gradation, the adder 102 of the energizing element number calculation unit 100 conducts the calculation of $$\sum_{J=0}^{K-1} D_J \tag{2}$$

and the subtracter 103 then calculates the number of elements to be energized for the Kth gradation $$N - \sum_{J=0}^{K-1} D_J \tag{3}$$

The calculation result is sent to a gap control circuit 110.

The gap control circuit 110 calculates the adjusting width $A_{MIN}$~$A_{MAX}$ for the gradation pulse $P_K$ on the basis of the calculation result.

The dual RAM has a read block and a write block separately so as to comply with the data transfer for the next line while the energization for the current line is conducted. In the dual RAM, therefore, the process of reading data for energization, and the process of writing data to be transferred can be conducted simultaneously. This improves the speed of the printing process.

In the embodiment, the adjustment of the energizing period is not based on gradation data for each head element, and therefore the operation of calculating the adjusting amount is not caused to become enormous.

Specifically, when the number of head elements for printing an image of gradation data of m levels (i.e., elements to be energized) is $n_m$ and the adjusting amount of the energizing period is $\Delta t(n_m)$, the total adjusting amount for gradation data of K levels can be calculated by $$\sum_{m=0}^{K-1} \Delta t(n_m) \tag{4}$$

This is the value for an ith head element. When one line includes an e number of elements to be energized, an e number of values must be calculated so that the calculation amount becomes enormous.

According to the invention, as described above, the number of elements to be energized among all head elements is counted for each gradation, and the energizing period is adjusted in a manner common to the elements to be energized, on the basis of the counted number. Therefore, the adjusting amount can be obtained in a simple manner and with a reduced computational complexity, and density unevenness due to a difference in the number of head elements to be energized between gradation can easily be prevented from occurring.

What is claimed is:

1. A thermal printer comprising:

a thermal head having a plurality of head elements;

energization period control means for controlling a common energization period of each of the plurality of head elements;

counter means for counting a number of said plurality of head elements which are to be energized for each gradation; and adjusting means for adjusting said common energizing period for each gradation on the basis of a number of said plurality of head elements counted by said counter means in order to prevent density unevenness which would otherwise occur because of differences in the number of head elements to be energized for each gradation, wherein the counter means comprises:

data number counter means for counting density data bits indicative of energization of each head element for each gradation to obtain a count value ($D_j$) representative of the total number of said density data bits;

memory means for storing a total number (N) of the head elements;

sum means for summing and latching the count values obtained by the data number counting means for each gradation which is lower than the gradation for which said energizing period to be adjusted by said adjusting means to obtain a sum $$\left(\sum_{j=0}^{K-1} D_j\right);$$

and head element counter means for counting each gradation by subtracting the summing data of said sum means from the stored data of said memory means to obtain said number $$\left(N - \sum_{j=0}^{K-1} D_j\right)$$

of said plurality of head elements which are to energized for each gradation.

* * * * *